US008474540B2

(12) United States Patent
Guesnon et al.

(10) Patent No.: US 8,474,540 B2
(45) Date of Patent: Jul. 2, 2013

(54) RISER SECTION CONNECTOR WITH FLANGES, INTERNAL LOCKING RING AND EXTERNAL LOCKING COLLAR

(75) Inventors: Jean Guesnon, Chatou (FR); Gérard Papon, Les Essarts le Roi (FR); Emmanuel Persent, Croissy sur Seine (FR)

(73) Assignee: IFP Energies Nouvelles, Cedex (FR)

( * ) Notice: Subject to any disclaimer, the term of this patent is extended or adjusted under 35 U.S.C. 154(b) by 150 days.

(21) Appl. No.: 13/028,442

(22) Filed: Feb. 16, 2011

(65) Prior Publication Data

US 2011/0203804 A1 Aug. 25, 2011

(30) Foreign Application Priority Data

Feb. 23, 2010 (FR) ..... 10 00728

(51) Int. Cl.
*E21B 7/12* (2006.01)

(52) U.S. Cl.
USPC ..... 166/367; 166/339; 166/341

(58) Field of Classification Search
USPC ..... 166/338, 341, 344, 351, 352, 360, 166/367, 378–380, 85.1
See application file for complete search history.

(56) References Cited

U.S. PATENT DOCUMENTS 3,353,847 A * 11/1967 Brown ..... 285/18
3,361,453 A * 1/1968 Brown et al. ..... 285/321
3,841,665 A * 10/1974 Capot ..... 285/2
4,043,575 A * 8/1977 Roth ..... 285/90
4,062,571 A * 12/1977 Sicard ..... 285/26
4,097,069 A * 6/1978 Morrill ..... 285/84
4,280,719 A * 7/1981 Daniel et al. ..... 285/90
4,374,595 A * 2/1983 Watkins ..... 285/123.2
4,487,434 A * 12/1984 Roche ..... 285/93
4,491,346 A * 1/1985 Walker ..... 285/18
4,496,173 A 1/1985 Roche et al.
4,519,633 A * 5/1985 Nichols ..... 285/3
4,550,936 A * 11/1985 Haeber et al. ..... 285/26
4,717,183 A * 1/1988 Nobileau ..... 285/334
4,867,483 A * 9/1989 Witt et al. ..... 285/23
4,902,044 A * 2/1990 Williams et al. ..... 285/18
5,178,216 A * 1/1993 Giroux et al. ..... 166/376
5,333,911 A * 8/1994 Watkins ..... 285/18
5,390,966 A * 2/1995 Cox et al. ..... 285/124.2
5,441,311 A * 8/1995 Watkins ..... 285/18
5,480,196 A * 1/1996 Adams, Jr. ..... 285/369
5,634,671 A * 6/1997 Watkins ..... 285/18

(Continued)

FOREIGN PATENT DOCUMENTS

DE 28 33 866 A1 2/1980
FR 2 526 517 11/1983

(Continued)

*Primary Examiner* — Thomas A Beach
*Assistant Examiner* — Aaron Lembo
(74) *Attorney, Agent, or Firm* — Antonelli, Terry, Stout & Kraus, LLP

(57) ABSTRACT

The connector comprises a male flange 15 and a female flange 14 allowing to assemble a main tube and auxiliary line tubes 11.

A locking collar 17 and a locking ring 40 assemble the male flange and the female flange. Locking collar 17 is mounted mobile in rotation on the outer surface of the male flange while cooperating with the outer surfaces of the male and female flanges. Locking ring 40 is mounted mobile in rotation on the male element of the connector while cooperating with the inner surface of the female connector.

18 Claims, 6 Drawing Sheets

U.S. PATENT DOCUMENTS

| | | | | |
|---|---|---|---|---|
| 5,658,018 | A * | 8/1997 | Hjertholm | 285/18 |
| 5,992,893 | A * | 11/1999 | Watkins | 285/18 |
| 6,401,825 | B1 * | 6/2002 | Woodrow | 166/350 |
| 6,419,277 | B1 * | 7/2002 | Reynolds | 285/123.1 |
| 6,623,044 | B1 * | 9/2003 | Guesnon et al. | 285/124.1 |
| 6,869,080 | B2 * | 3/2005 | Janoff et al. | 277/603 |
| 7,331,395 | B2 * | 2/2008 | Fraser et al. | 166/345 |
| 7,341,281 | B2 * | 3/2008 | Guesnon et al. | 285/81 |
| 7,762,337 | B2 * | 7/2010 | Papon et al. | 166/345 |
| 7,913,767 | B2 * | 3/2011 | Larson et al. | 166/380 |
| 7,975,768 | B2 * | 7/2011 | Fraser et al. | 166/345 |
| 8,037,939 | B2 * | 10/2011 | Poirette et al. | 166/367 |
| 8,210,265 | B2 * | 7/2012 | Alikin et al. | 166/367 |
| 2007/0044973 | A1 | 3/2007 | Fraser et al. | |
| 2010/0300699 | A1 * | 12/2010 | Papon et al. | 166/367 |
| 2011/0073315 | A1 * | 3/2011 | Guesnon et al. | 166/367 |
| 2011/0209878 | A1 * | 9/2011 | Guesnon | 166/367 |

FOREIGN PATENT DOCUMENTS

| | | | |
|---|---|---|---|
| FR | 2 891 577 | A1 | 4/2007 |
| FR | 2 891 578 | A1 | 4/2007 |
| FR | 2 891 579 | A1 | 4/2007 |
| FR | 2 925 105 | A1 | 6/2009 |

* cited by examiner

RISER SECTION CONNECTOR WITH FLANGES, INTERNAL LOCKING RING AND EXTERNAL LOCKING COLLAR

FIELD OF THE INVENTION

The present invention relates to the sphere of very deep sea drilling and oil field development. It concerns a connector for assembling two riser pipe sections.

BACKGROUND OF THE INVENTION

A riser pipe is made up of an assembly of tubular elements assembled by connectors. The tubular elements generally consist of a main tube provided with a connector at each end thereof. The main tube is fitted with auxiliary lines commonly, but not exclusively, referred to as "kill line", "choke line", "booster line" and "hydraulic line", which allow circulation of a technical fluid to the well and of a formation fluid to the surface. The tubular elements are assembled on the drilling site, from a floater. The riser pipe is lowered into the water depth as the tubular elements are assembled, until the wellhead located on the sea bottom is reached.

In the perspective of drilling at water depths that can reach 3500 m or more, the weight of the riser pipe becomes very penalizing. This phenomenon is increased by the fact that, for the same maximum working pressure, the length of the riser requires a larger inside diameter for the auxiliary lines considering the necessity to limit pressure drops.

Besides, the necessity to decrease the riser pipe assembly time is all the more critical since the water depth, and therefore the riser length, are great.

Documents FR-2,891,577, FR-2,891,578 and FR-2,891,579 describe various solutions notably aiming to involve the auxiliary lines, together with the main tube, in the taking up of the longitudinal stresses undergone by the riser pipe.

The present invention describes an alternative solution providing a compact connector design well suited for deep-sea risers, i.e. located at depths greater than 2000 meters.

SUMMARY OF THE INVENTION

In general terms, the present invention relates to a connector for assembling two riser pipe sections for offshore well drilling operations. The connector comprises a first main tube element having as an extension a male connector element provided with a male flange pierced by at least one orifice wherein a first auxiliary tube element is secured, and a second main tube element having as an extension a female connector element provided with a female flange pierced by at least one orifice wherein a second auxiliary tube element is secured. The male connector element fits into the female connector element so as to connect the two main tube elements and the two auxiliary tube elements. The invention is characterized in that the connector comprises a locking collar and a locking ring. The locking collar is mounted mobile in rotation on the outer surface of the male flange, the locking collar cooperating with the outer surfaces of the male and female flanges for assembling the male flange and the female flange. The locking ring is mounted mobile in rotation on the male connector element, the locking ring cooperating with the inner surface of the female connector for assembling the male connector and the female connector.

According to the invention, the locking collar can be locked in translation by an axial shoulder provided on the male flange, and the collar can be provided with tenons that cooperate with the tenons arranged on the outer surface of the female flange.

The tenons of the locking collar can be arranged on the inner surface of the collar.

The locking collar can comprise a number of tenons equal to the number of auxiliary lines operating according to a hyperstatic mode.

Said axial shoulder provided on the male flange can comprise teeth that cooperate with teeth arranged on the inner surface of the collar.

The connector can comprise thrusts for limiting the rotation of the locking collar between an open position and a closed position. Furthermore, the connector can comprise immobilization means for locking the collar in rotation at least in the open position and in the closed position.

The ring can be provided with tenons that cooperate with tenons arranged on the inner surface of the female connector element.

Each tenon of the locking collar and of the male flange can extend over an angular portion smaller than the smaller value among $$\frac{180°}{N} \text{ and } \frac{360°}{N} - \frac{180°}{P} - 5°,$$

N being the number of tenons of the locking collar arranged over a circumference of the collar, P being the number of tenons of the ring arranged over a circumference of the ring.

The locking collar can be tubular and provided with at least one lateral opening.

The collar can have a cylindrical surface portion that cooperates with a cylindrical surface portion of the male flange on the periphery of the male flange.

Each auxiliary tube element can be axially abutted against a shoulder provided in the orifices.

The locking collar can be secured in rotation to the locking ring.

At least one of the elements selected from the group consisting of a main tube element and of an auxiliary line element can comprise a steel tube hooped by composite strips. Said composite strips can comprise glass, carbon or aramid fibers, coated with a polymer matrix.

At least one of the elements selected from the group consisting of a main tube element and of an auxiliary line element can be made of a material selected from the list consisting of a composite material comprising reinforcing fibers coated with a polymer matrix, an aluminium alloy, a titanium alloy.

The invention also relates to a riser pipe comprising at least two riser pipe sections assembled by a connector according to the invention, wherein the longitudinal tensional stresses are distributed among the main tube element and the auxiliary tube element.

The connector according to the invention exhibits a set of qualities:

- capacity to transmit great stresses coming from the main tube and the auxiliary lines,
- great stiffness resulting from locking by means of the internal ring and of the external collar, which allows to limit the deformations and overstresses to acceptable levels,
- possibility of making an entirely dismountable assembly, so as to allow maintenance operations to be easily carried out, simple, robust and fast implementation with full vision of the parts upon connection.

BRIEF DESCRIPTION OF THE FIGURES

Other features and advantages of the invention will be clear from reading the description hereafter, with reference to the accompanying figures wherein.

DETAILED DESCRIPTION

Figure 1:
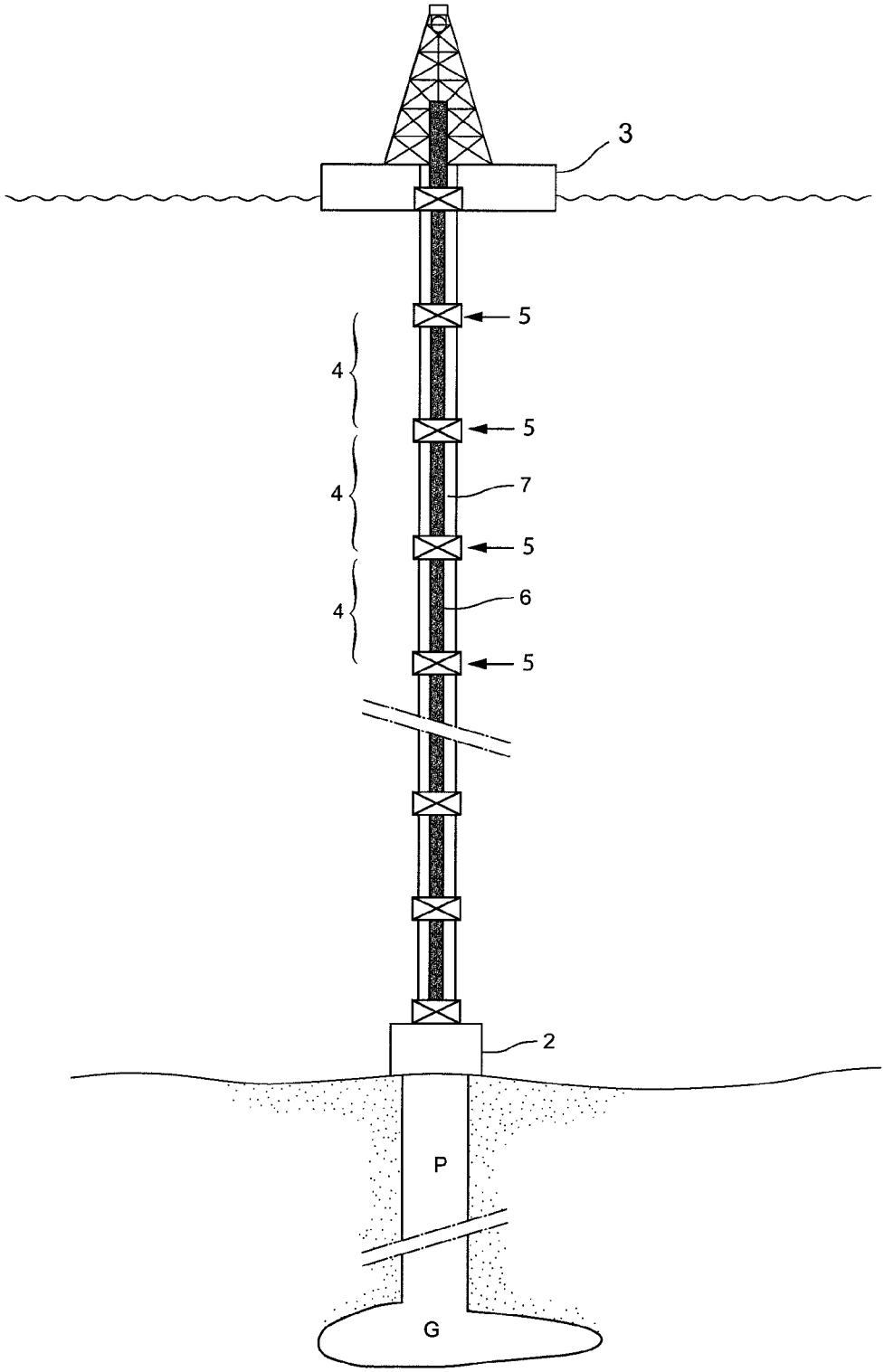
FIG. 1 diagrammatically shows a riser pipe.

FIG. 1 diagrammatically shows a riser pipe 1 installed offshore in order to develop a reservoir G. Riser 1 forms an extension of well P and it extends from wellhead 2 to floater 3, a platform or a vessel for example. Wellhead 2 is provided with a preventer commonly referred to as "B.O.P." or "Blow-Out Preventer". The riser is made up of an assembly of several sections 4 assembled end to end by connectors 5. Each section consists of a main tube element 6 provided with at least one peripheral line element 7. The auxiliary lines referred to as kill lines or choke lines are used to provide well safety during control procedures relative to the inflow of fluids under pressure in the well. The line referred to as booster line allows mud to be injected into the main tube at the foot of the riser. The line referred to as hydraulic line allows a hydraulic fluid to be injected so as to control the blow-out preventer of the wellhead.

Figure 2:
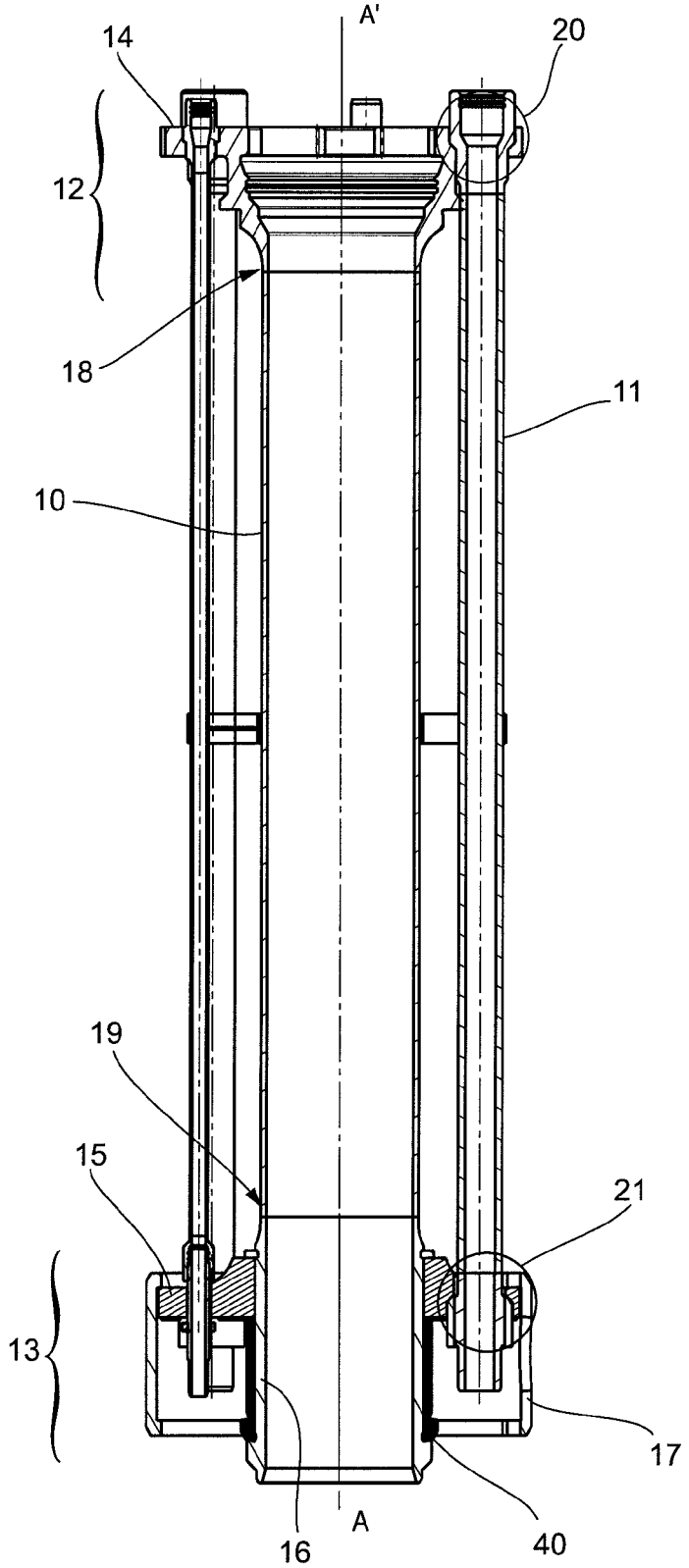
FIG. 2 shows a riser pipe section according to the invention.

FIG. 2 diagrammatically shows a section 4 of the riser pipe. The section comprises a main tube element 10 whose axis AA' is the axis of the riser. Tube 11 makes up an auxiliary line or duct arranged parallel to axis AA'. Element 11 has a length substantially equal to the length of main tube element 10, generally ranging between 10 and 30 meters. There is at least one line 11 arranged on the periphery of the main tube.

A connector 5 shown in FIG. 1 consists of two elements designated, with reference to FIG. 2, by female connector element 12 and male connector element 13. Elements 12 and 13 are mounted at the ends of main tube element 10. Female connector element 12 consists of a flange 14. Male connector element 13 consists of a flange 15 mounted on a male element 16. Alternatively to the representation of 15 and 16 in FIGS. 2 and 3, flange 15 and element 16 can make up a single part. Female connector element 12 is secured to tube 10, for example by welding 18, by screwing, by crimping or by clamping linkage. Male connector element 13 is secured to tube 10, for example by welding 19, by screwing, by crimping or by clamping linkage. Locking collar 17 and locking ring 40 allow male connector element 13 and female connector element 12 to be assembled. Elements 12 and 13, collar 17 and ring 40 form connector 5 that transmits stresses from one riser section to the next section, notably the longitudinal stresses, i.e. the tensional stresses oriented along axis AA' undergone by the riser.

Connector 5 can be designed and dimensioned so as to meet the specifications defined by the American Petroleum Institute standards, notably the API 16 R, API 16 F, API 16 Q and API 2 RD standards.

Figure 3:
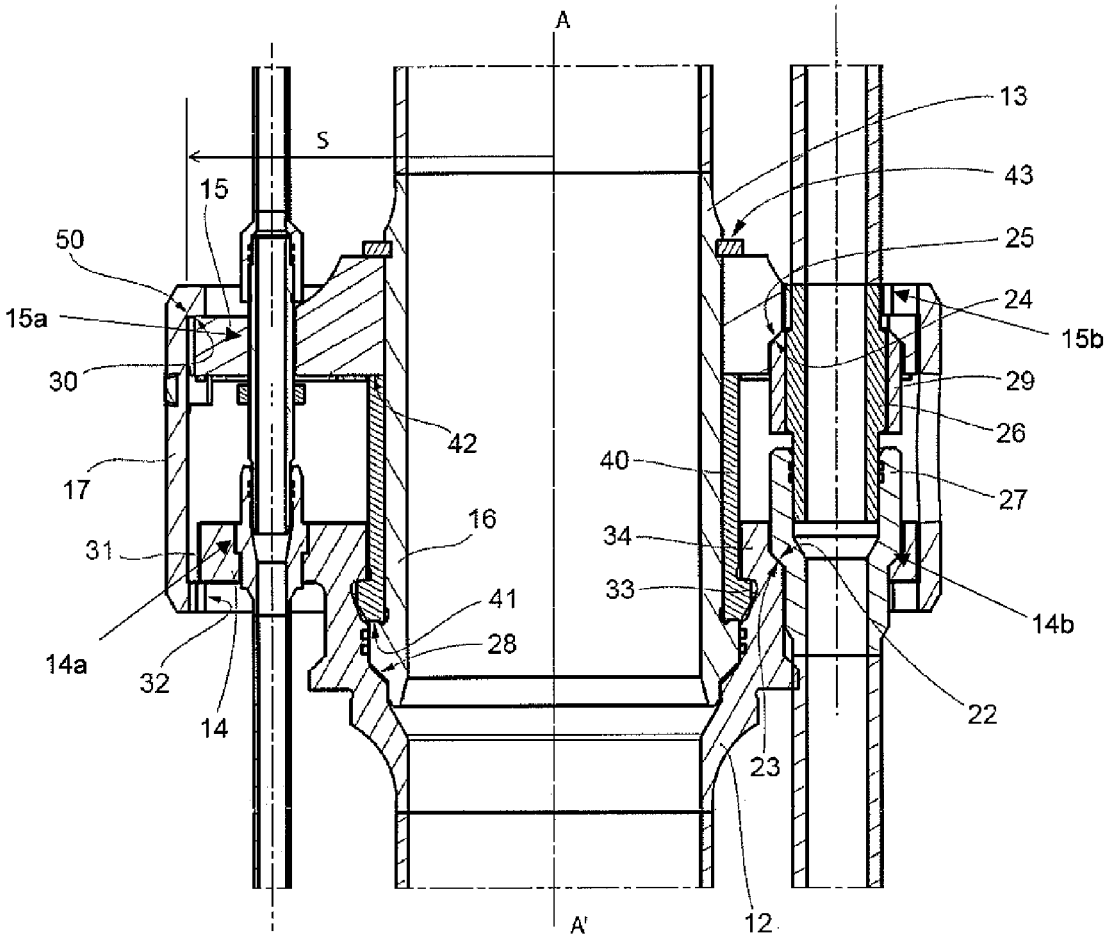
FIG. 3 shows a connector according to the invention in locked position.

FIG. 3 shows a male tubular element 13 fitted in female tubular element 12. A portion of male element part 16 penetrates inside female tubular element 12. This fitting is limited by axial thrust 28 of male element 16 that abuts against female connector element 12.

According to the invention, connector 5 comprises a locking collar 17 positioned on the outer surface of flanges 14 and 15. Collar 17 can be machined in a tube portion. Collar 17 is provided, at each end thereof, with thrusts that cooperate with flanges 14 and 15 respectively so as to lock in translation along axis AA' flanges 14 and 15. Locking collar 17 is mounted mobile in rotation on flange 15 while being locked in translation in the direction of axis AA'. With reference to FIG. 3, collar 17 comprises at least a cylindrical inner surface portion of radius S and the outer peripheral surface of flange 15 is cylindrical, with a radius slightly smaller than S. Collar 17 is mounted on flange 15 by centering the inner cylindrical surface of the collar on the outer cylindrical surface of flange 15. Furthermore, collar 17 comprises a neck 50 that forms a radial projection of the cylindrical inner surface of collar 17. The collar rests on axial shoulder 30 provided on flange 15. The inner surface of collar 17 comprises tenons. Flange 14 also comprises tenons arranged on the outer peripheral surface thereof. When element 13 fits into female element 12, part of collar 17 covers flange 14 so that tenons 32 of collar 17 can cooperate with tenons 31 of female element 14.

According to the invention, connector 5 also comprises a locking ring 40 that is positioned between element 12 and element 16. When element 16 is fitted in female element 12, part of ring 40 penetrates inside female element 12 so that tenons 33 of ring 40 can cooperate with tenons 34 of female element 12. Locking ring 40 is mounted mobile in rotation on male element 16, while being locked in translation, in particular in the direction of axis AA'. With reference to FIG. 3, ring 40 is mounted on the outer surface of element 16. It is held in a housing defined and limited by axial shoulder 41 provided on element 16 and axial shoulder 42 defined by flange 15. In order to mount locking ring 40 on element 16, male connector element 13 can be made of two parts 15 and 16. Ring 40 is mounted on part 16 until it abuts against axial shoulder 41 provided on the outer surface of element 16. Flange 15 is then secured to element 16 so that ring 40 abuts against shoulder 42 of element 16. For example, flange 15 is screwed or welded onto element 16 or, as shown in FIG. 3, flange 15 is held in position by part 43, which can be made of two parts, housed in a slot provided in element 13. Alternatively, parts 15 and 16 of element 13 can form a single part. In this case, ring 40 can consist of two parts that are assembled around part 16 of element 13.

Locking and unlocking of connector 5 is achieved through rotation of collar 17 and rotation of locking ring 40 (bayonet type locking). Collar 17 and ring 40 are provided with operating means, for example an operating bar that can be removable. The operating means allow to rotate collar 17 around flanges 14 and 15 along axis AA' and, independently or simultaneously, to rotate ring 40 around element 16 along axis AA'. With a view to simultaneous rotation of the collar and of the ring, collar 17 can be secured to ring 40 by a rigid link (for example by means of rods or of a hollowed plate preventing any interference with the auxiliary lines upon rotation of the locking assembly made up of the ring and the collar).

Rotation abutment means and means for locking the ring/collar system in locked and unlocked position can be provided, for example by means of blocks, pins, spindles or screws arranged on flange 15 and collar 17.

In parallel with circular neck 50, a guide means (not shown) on flange 15 allows to hold collar 17 in a locked connector position, even if axial stresses are exerted on its lower end, for example by setting accidentally the riser section on collar 17 upon passage through the rotary table or during particular operations.

The longitudinal stresses, i.e. the tensional stresses applied along axis AA', are transmitted from a section 4 to adjacent section 4, on the one hand through the agency of the bayonet type connection between collar 17 and flanges 14 and 15 and, on the other hand, through the agency of the bayonet type connection between ring 16 and element 12. More precisely, at the level of collar 17, the tensional stresses exerted along axis AA' are transmitted from a riser section to another by the connector as follows: the tensional stresses are transmitted from element 13 to flange 15 through ring 40, through shoulders 41 and 42, then from flange 15 to collar 17 through shoulder 30, then collar 17 transmits the tensional stresses to flange 14 of the adjacent section via tenons 32 of collar 17 that cooperate with tenons 31 of flange 14. At the level of ring 40, the tensional stresses exerted along axis AA' are transmitted from a riser section to another by the connector as follows: the tensional stresses are transmitted from element 13 to ring 40 through shoulder 41, then from ring 40 to element 12 through tenons 33 and 34.

The layout of the connector according to the invention allows to transmit nearly all of the stresses in the main tube through the agency of internal ring 40, while the stresses in the auxiliary lines are transmitted partly via internal ring 40 and partly via external collar 17. The distribution of the stresses in the auxiliary lines among ring 40 and collar 17 notably depends on the stress and on the stiffness of the external collar. It is thus possible to determine a set of parameters for the connector according to the invention (for example the stiffness of flanges 14 and 15, of collar 17, of tenons 31 and 32) so as to minimize overstresses in the auxiliary lines induced by the flexural deformations of the flanges.

The height of collar 17 can be determined in such a way that the distance between the lower face of circular neck 50 and the upper face of tenons 32 is equal to the distance between flanges 14 and 15 increased by a running clearance at least equal to that of internal ring 40. Furthermore, a space is required between the two flanges 14 and 15 for housing end parts 26 and 27 of auxiliary line tubes 11 and the clearance adjustment system.

Openings can be provided in the parts of collar 17 located, vertically and circumferentially, between the tenons. These openings allow on the one hand to lighten the part, and also notably to see the ends of auxiliary line elements 11 while connecting them and to avoid damages that might result from a blind approach.

Figure 4:
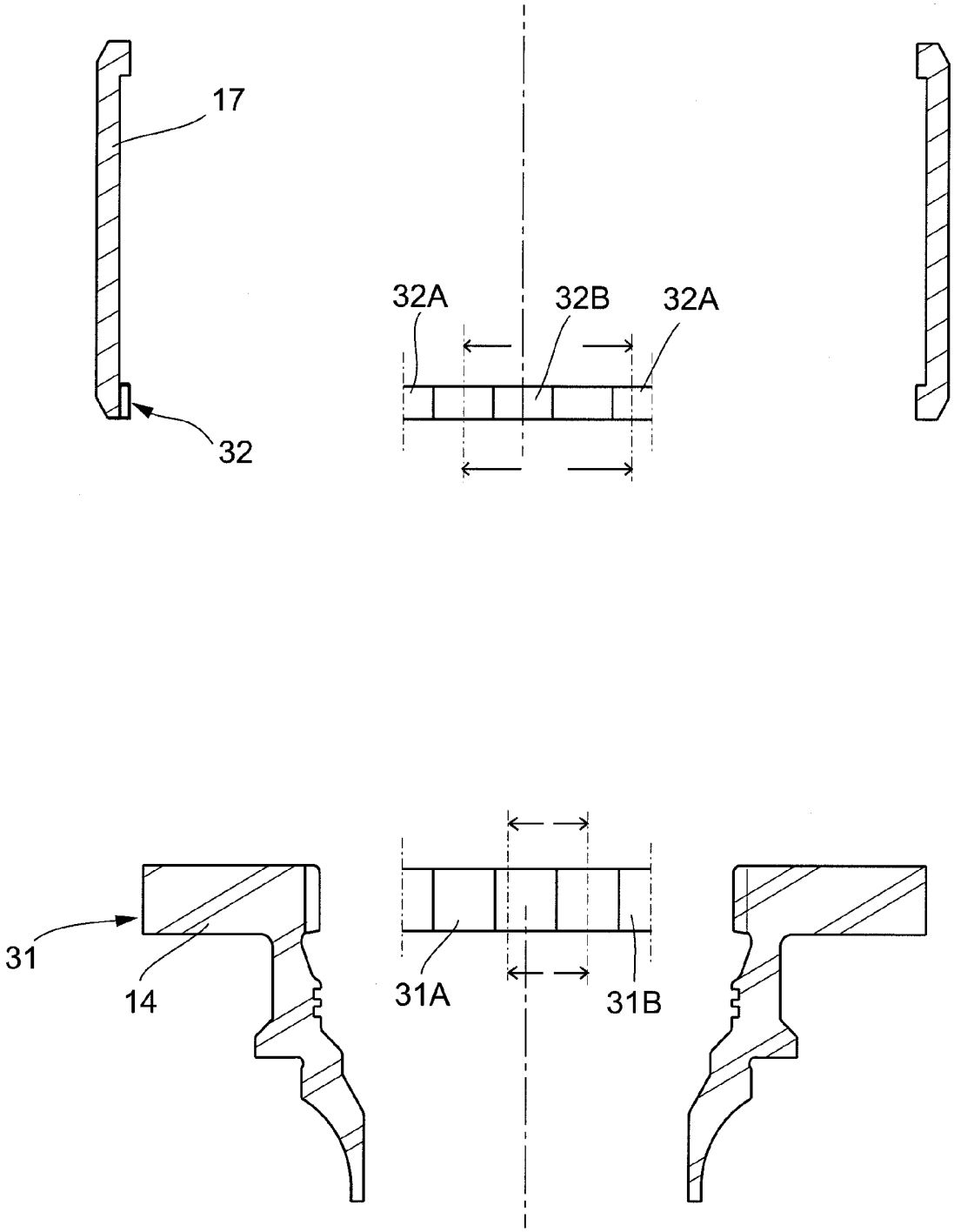
FIG. 4 shows the details of the locking collar of the connector according to the invention.

FIG. 4 shows in detail the respective crowns of tenons 31 and 32 of flange 14 and of collar 17. Tenons 31A and 31B of crown 31 of flange 14 are shown in developed view of the outer surface of flange 14. Tenons 32A and 32B of crown 32 of collar 17 are shown in developed view of the inner surface of collar 17.

Tenons 31A and 31B of collar 17 cooperate with tenons 32A and 32B of flange 14 to form a bayonet assembly.

More precisely, when collar 17 fits around flange 14, the assembly made up of collar 17, flange 15, male part 16 and ring 40 performs a descending translational motion in the direction of axis AA' according to the successive stages as follows:

- tenons 32A and 32B fit between tenons 31A and 31B, then
- when male part 16 abuts against bearing surface 28 of element 12, tenons 32A and 32B come beneath flange 14,
- collar 17 is rotated about axis AA' until the tenons of the collar are positioned opposite the tenons of flange 14.

Thus, tenons 32A, 32B of collar 17 face tenons 31A, 31B of flange 14 and lock in translation flange 14 with respect to flange 15.

Preferably, the tenons of flange 14 are positioned vertical to auxiliary line elements 11 that are secured to flanges 14 and 15 and therefore operate in hyperstatic mode. The crowns of tenons 31 and 32 can thus comprise each 2, 3, 4 tenons or more, FIG. 4 shows a crown with two tenons to facilitate reading of the diagram. However, a crown comprising a number of tenons N equal to the number of auxiliary lines 11 in hyperstatic operating mode is generally used. Furthermore, these tenons, arranged on the periphery of the connector, can occupy only a reduced angular sector a. According to the invention, a can be the smaller of the two values (I) and (II) as follows:

$$\frac{360°}{N} - \frac{180°}{P} - 5° \left(\text{preferably less than } \frac{360°}{N} - \frac{180°}{P} - 10°\right) \quad \text{(I)}$$

$$\frac{180°}{N}, \quad \text{(II)}$$

where N designates the number of tenons of a crown (crown 32) of collar 17 and P designates the number of tenons of a crown (crown 33) of ring 40 described hereafter. The reduced angular sector corresponds to a developed tenon length sufficient to withstand the stresses applied. For example, if crown 32 of collar 17 comprises 3 tenons, and crown 33 of ring 40 comprises 4 tenons, each tenon of collar 17 can occupy an angular sector smaller than $$\frac{180°}{3} = 60°$$

imposed by term (II). In the case where crown 32 of collar 17 and crown 33 of ring 40 comprise each 4 tenons, each tenon of collar 17 can occupy an angular sector smaller than 40°, preferably smaller than 35°, imposed by term (I). This layout of the tenons occupying reduced angular sectors allows to design an external collar 17 with three angular positions as described hereafter with reference to FIG. 5.

Figure 5:
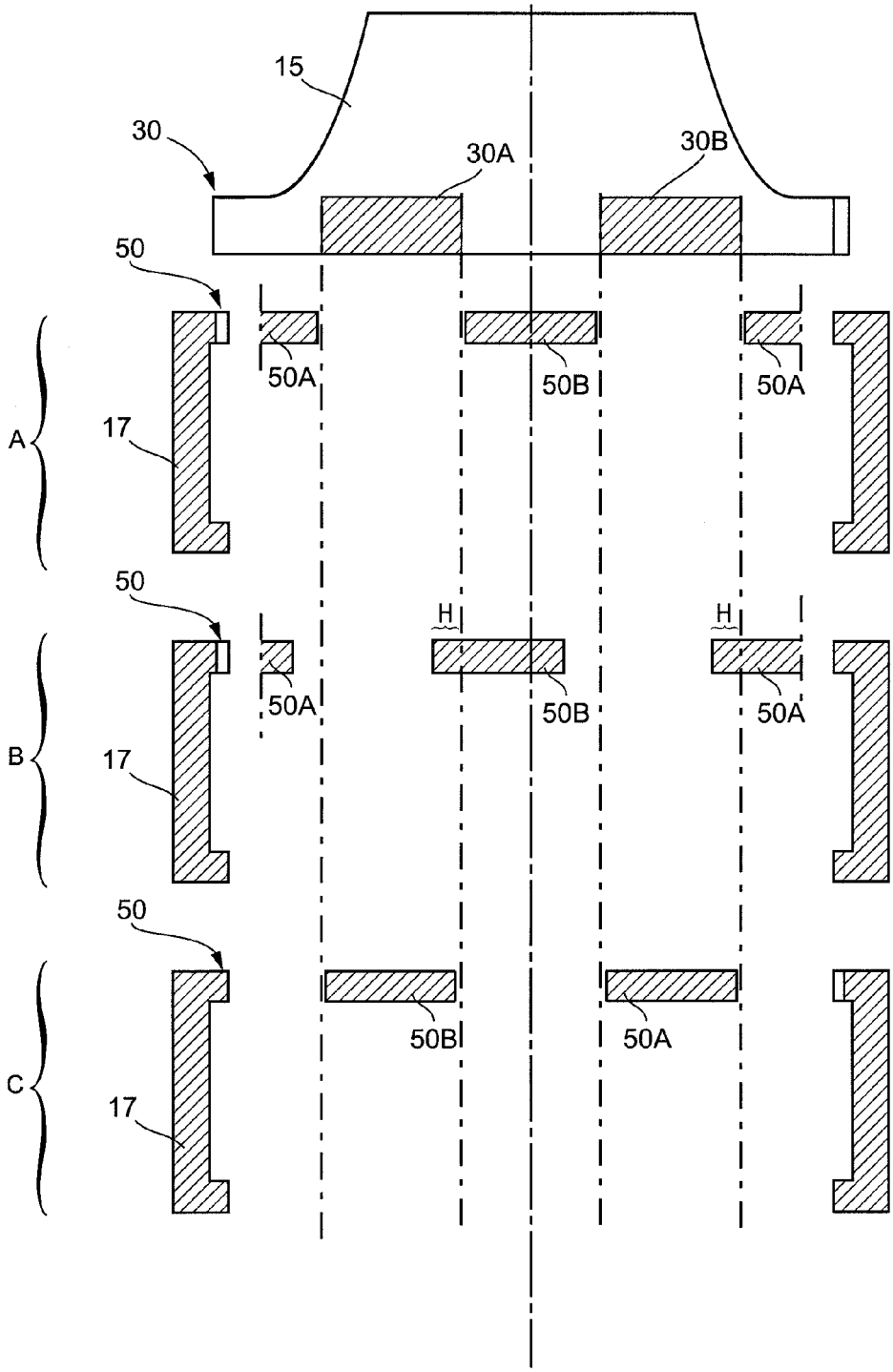
FIG. 5 shows various positions of the locking collar with respect to the male flange according to the invention.

FIG. 5 shows in detail neck 50 of collar 17 and shoulder 30 of flange 15. According to the invention, neck 50 consists of a crown of teeth 50A and 50B and shoulder 30 consists of a crown of teeth 30A and 30B. In FIG. 5, neck 50 and shoulder 30 comprise two teeth to facilitate reading of the diagram. However, a crown comprising a number of teeth N equal to the number of auxiliary lines 11 in hyperstatic operating mode is generally used. FIG. 5 shows collar 17 in three different positions A, B and C with respect to flange 15. Reference A corresponds to collar 17 in a dismounted position. Teeth 50A and 50B of neck 50 can slide between teeth 30A and 30B of flange 15. Thus, the collar can be extracted from flange 15. Reference B corresponds to collar 17 in an open position allowing fitting of the connector. Teeth 50A and 50B of neck 50 rest against a small portion H of teeth 30A and 30B of flange 15. Portion H corresponds to an angular sector smaller than 10°, preferably smaller than 5°. Thus, the collar abuts against flange 15 on portion H of the teeth of flange 15. Reference C corresponds to collar 17 in a closed position. Teeth 50A and SOB of neck 50 rest over the entire length thereof against teeth 30A and 30B allowing transfer of the stresses.

Figure 6:
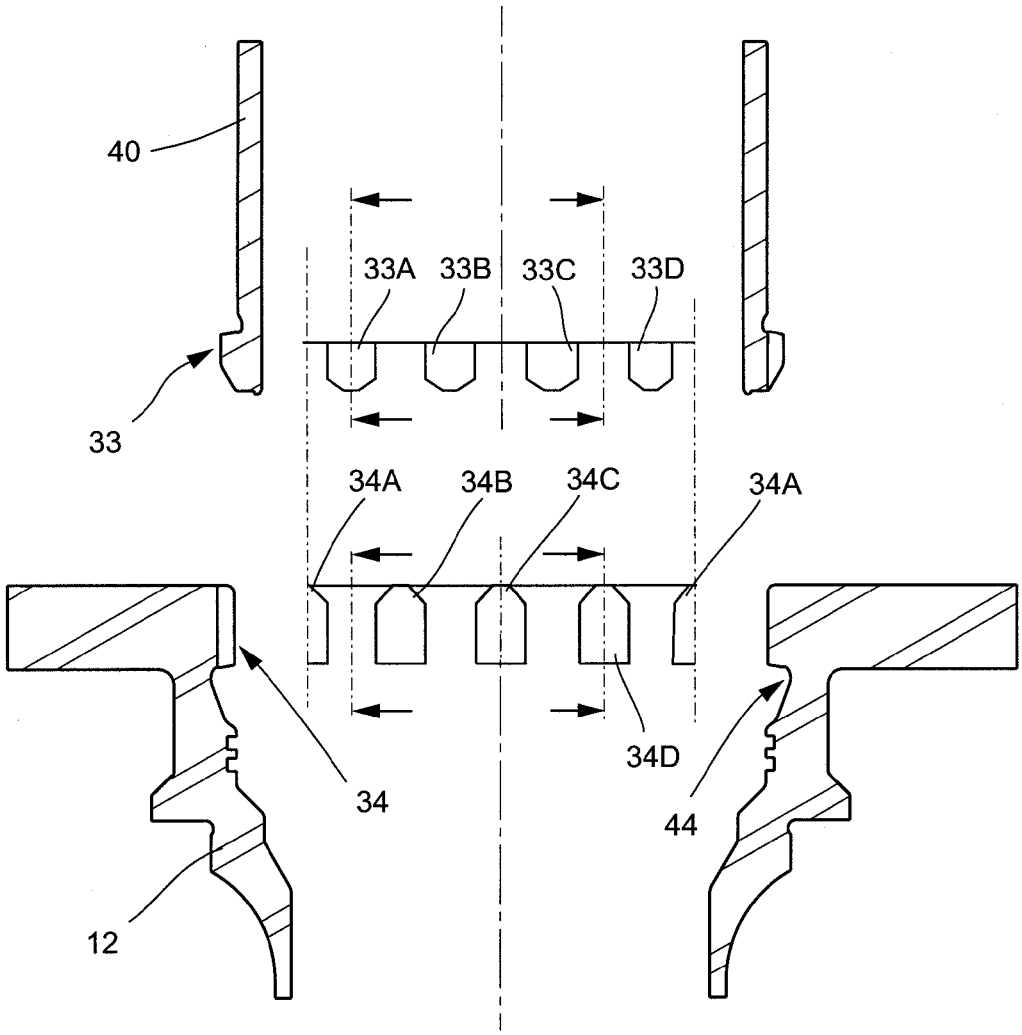
FIG. 6 shows the details of the locking ring of the connector according to the invention.

FIG. 6 shows in detail the respective crowns of tenons 33 and 34 of ring 40 and of element 12. Tenons 33A, 33B, 33C and 33D of crown 33 of ring 40 are shown in developed view of the outer surface of ring 40. Tenons 34A, 34B, 34C and 34D of crown 34 of element 12 are shown in developed view of the inner surface of element 12.

Tenons 33A, 33B, 33C and 33D of ring 40 cooperate with tenons 34A, 34B, 34C and 34D of element 12 to form a bayonet assembly.

More precisely, when ring 40 fits into element 12, the assembly made up of ring 40, flange 15, male element 16 and collar 17 performs a descending translational motion in the direction of axis AA' according to the successive stages as follows:

- tenons 33A, 33B, 33C and 33D of ring 40 fit between tenons 34A, 34B, 34C and 34D of element 12, then
- when male element 16 abuts against bearing surface 28 of female element 12, the tenons insert into circular slot 44 provided in element 12 below crown of tenons 34,
- the ring is rotated until the tenons of ring 40 are positioned opposite the tenons of element 12.

Thus, tenons 33 of ring 40 are axially abutted with respect to tenons 34 of element 12 and lock in translation flange 14 with respect to flange 15.

The bayonet assembly system can allow to provide, between tenons 34 of element 12 and tenons 33 of ring 40, contact over a total angular range that can nearly reach 180° (except for the circular clearance between the tenons). Alternatively, according to the invention, ring 40 and element 12 can comprise each two crowns of tenons: the tenons of the two crowns of ring 40 cooperate respectively with the tenons of the two crowns of element 12. In this case, the two assembly systems can be angularly offset around axis AA', the connector according to the invention allowing the axial loads to be distributed over nearly 360° around the axis.

The number of tenons per crown and their geometry can vary, notably depending on the diameters of the inner tube and on the stresses to be transmitted by the connector.

Auxiliary line element 11 is secured, at each end thereof, to main tube 10. In other words, riser section 1 comprises at each end thereof fastening means 20 and 21, diagrammatically shown in FIG. 2, allowing an auxiliary line element 11 to be axially linked to main tube 10. According to the invention, means 20 and 21 allow longitudinal stresses to be transmitted from main tube 10 to elements 11. Thus, these fastening means 20 and 21 allow the tensional stresses applied to each section of the riser pipe to be distributed among main tube 10 and auxiliary line elements 11.

With reference to FIG. 3, at the level of the section end provided with female connector means 12, main tube 10 has as an extension shoulder or flange 14 that is pierced by orifices 14*a* and 14*b*. The extension shoulder or flange 14 may comprise a cylindrical passage wherein auxiliary line element 11 can slide. Auxiliary tube element 11 comprises a thrust 22, a nut or a shoulder for example, intended to position element 11 axially with respect to flange 14. When mounting element 11 on main tube 10, thrust 22 of element 11 rests against flange 14, for example against axial shoulder 23 provided in the cylindrical passage so as to form a rigid link.

At the level of the section end provided with male connector means 13, main tube 10 has as an extension shoulder or flange 15 that is pierced by orifices 15*a* and 15*b*. The extension shoulder or flange 15 may comprise a cylindrical passage wherein auxiliary line element 11 can slide. Auxiliary line element 11 comprises a thrust 24, a nut or a shoulder for example, intended to position element 11 axially with respect to flange 15. When mounting element 11 on main tube 10, thrust 24 of element 11 rests against flange 15, for example against axial shoulder 25 provided in the cylindrical passage so as to form a rigid link.

Flanges 14 and 15 have shapes of revolution around axis AA'. Flanges 14 and 15 form an extension of main tube elements 10 while increasing the thickness and the outer section of the tube, so as to form shoulders respectively. Preferably, the outer section of flanges 14 and 15 varies progressively along axis AA' so as to avoid a sudden section variation between tube 10 and the shoulders that would weaken the mechanical strength of connector 5.

Fastening means 20 consisting of thrusts 22 and 23 allow to lock the axial translations of an element 11 in a direction with respect to main tube 10. Fastening means 21 consisting of thrusts 24 and 25 allow to lock the axial translations of an element 11 in the opposite direction with respect to the main tube. The combination of fastening means 20 and of fastening means 21 allows element 11 to be completely secured with respect to main tube element 10. Thus, elements 11 are involved, together with main tube element 10, in the taking up of the longitudinal stresses undergone by pipe 1.

The shape and in particular the thickness of flanges 14 and 15 are determined so as to withstand the longitudinal stresses transmitted to auxiliary line elements 11.

Auxiliary line elements 11 are connected end to end by means of connections. A connection is made up of a male end part 26 arranged at one end of element 11 and of a female end part 27 arranged at the other end of element 11. Male end part 26 cooperates tightly with female end part 27 of another element 11. For example, male element 26 of the connection is a tubular part that fits into another tubular part 27. The inner surface of female end part 27 is adjusted to the outer surface of male end part 26. Joints are mounted in slots machined on the inner surface of female element 27 so as to provide a tight link. The connection allows axial displacement of one of elements 11 with respect to the other, while maintaining the tight link between the two elements.

Tube elements 11 can be provided with a device for adjusting length differences between main tube 10 and tube elements 11 due to manufacturing tolerances. For example, nut 29 is screwed onto end part 26 so as to adjust the position of thrust 24 with respect to thrust 25.

The following operations can be carried out to achieve connection of the connector according to the invention.

Operation 1

Collar 17 and ring 40 are kept in open position by the locking system.

Male element 13 of a section faces female element 12 of another section. For example, female element 12 is suspended from a handling table and the section comprising element 13 is operated by hoisting means.

The position of auxiliary line elements 11 allows element 13 to be angularly positioned with respect to element 12.

Operation 2

Male element 13 is slid longitudinally in female element 12 until the two elements fit into and abut against one another.

When element 13 fits into element 12, on the one hand, the tenons of collar 17 slide between the tenons of flange 14 as described above, the tenons of ring 40 slide between the tenons of element 12 as described above and male end parts 26 of elements 11 penetrate inside female end parts 27 of elements 11.

Operation 3

When element 13 is completely fitted inside element 12, i.e. abutted against shoulder 28, collar 17 and ring 40 are released in rotation by acting upon the locking system, then collar 17 and ring 40 are pivoted around the connector axis.

Rotation of collar 17 and of ring 40 is performed until a closed position is reached, i.e. until the tenons of collar 17 are positioned opposite the tenons of flange 14 and until the tenons of ring 40 are positioned opposite the tenons of element 12. The locking system can limit rotation of the collar and of the ring.

When collar 17 and ring 40 are in closed position, the collar and the ring are immobilized with respect to flange 14 and element 12 by acting upon the locking system.

Operation 4

The entire riser pipe thus connected is raised. This has the effect of placing the connector under tension and of taking up the operating clearances: tenons 32 of collar 17 come effectively into contact with tenons 31 of flange 14 and tenons 33 of ring 40 come effectively into contact with tenons 34 of element 12.

Furthermore, in order to produce risers that can operate at depths reaching 3500 m and more, main tube 10 and auxiliary lines 11 can be made with metallic tube elements whose resistance is optimized by composite hoops made of fibers coated with a polymer matrix.

A tube hooping technique can be the technique consisting in winding under tension composite strips around a metallic tubular body, as described in documents FR-2,828,121, FR-2, 828,262 and U.S. Pat. No. 4,514,254.

The strips consist of fibers, glass, carbon or aramid fibers for example, the fibers being coated with a polymer matrix, thermoplastic or thermosetting, such as a polyamide.

A technique known as self-hooping can also be used, which consists in creating the hoop stress during hydraulic testing of the tube at a pressure causing the elastic limit in the metallic body to be exceeded. In other words, strips made of a composite material are wound around the tubular metallic body. During the winding operation, the strips induce no stress or only a very low stress in the metallic tube. Then a predetermined pressure is applied within the metallic body so that it deforms plastically. After return to a zero pressure, residual compressive stresses remain in the metallic body and tensile stresses remain in the composite strips.

The thickness of the composite material wound around the metallic tubular body, preferably made of steel, is determined according to the hoop prestress required for the tube to withstand, according to the state of the art, the pressure and tensile stresses.

According to another embodiment, tube elements 10 and 11 that make up the main tube and the auxiliary lines can be made of an aluminium alloy. For example, aluminium alloys with ASTM (American Standard for Testing and Material) references 1050, 1100, 2014, 2024, 3003, 5052, 6063, 6082, 5083, 5086, 6061, 6013, 7050, 7075, 7055 or aluminium alloys marketed under reference numbers C405, CU31, C555, CU92, C805, C855, C70H by the ALCOA Company can be used.

Alternatively, tube elements 10 and 11 that make up the main tube and the auxiliary lines can be made of a composite material consisting of fibers coated with a polymer matrix. The fibers can be carbon, glass or aramid fibers. The polymer matrix can be a thermoplastic material such as polyethylene, polyamide (notably PA11, PA6, PA6-6 or PA12), polyetheretherketone (PEEK) or polyvinylidene fluoride (PVDF). The polymer matrix can also be made of a thermosetting material such as epoxys.

Alternatively, tube elements 10 and 11 that make up the main tube and the auxiliary lines can be made of a titanium alloy. For example, a Ti-6-4 titanium alloy (alloy comprising, in wt. %, at least 85% titanium, about 6% aluminium and 4% vanadium) or the Ti-6-6-2 alloy comprising, in wt. %, about 6% aluminium, 6% vanadium, 2% tin and at least 80% titanium, can be used.

The invention claimed is:

1. A connector for assembling two riser pipe sections for offshore well drilling operations, comprising a first main tube element having as an extension a male connector element provided with a male flange pierced by at least one orifice wherein a first auxiliary tube element is secured, and a second main tube element having as an extension a female connector element provided with a female flange pierced by at least one other orifice wherein a second auxiliary tube element is secured, the male connector element fitting into the female connector element so as to connect the two main tube elements and the two auxiliary tube elements, characterized in that the connector comprises a locking collar and a locking ring, the locking collar being mounted mobile in rotation on an outer surface of the male flange, the locking collar cooperating with the outer surface of the male flange and an outer surface of the female flange for assembling the male flange and the female flange, the locking ring being mounted mobile in rotation on the male connector element, the locking ring cooperating with an inner surface of the female connector for assembling the male connector and the female connector.

2. A connector as claimed in claim 1, characterized in that the locking collar is locked in translation by an axial shoulder provided on the male flange, and the collar is provided with tenons that cooperate with tenons arranged on the outer surface of the female flange.

3. A connector as claimed in claim 2, characterized in that the tenons of the locking collar are arranged on an inner surface of the collar.

4. A connector as claimed in claim 2, characterized in that the locking collar comprises a number of tenons equal to the number of auxiliary lines operating in hyperstatic mode.

5. A connector as claimed in claim 2, characterized in that the axial shoulder provided on the male flange comprises teeth that cooperate with teeth arranged on the inner surface of the collar.

6. A connector as claimed in claim 2, comprising thrusts for limiting the rotation of the locking collar between an open position and a closed position, and immobilization means for locking the collar in rotation at least in the open position and in the closed position.

7. A connector as claimed in claim 2, characterized in that the ring is provided with tenons that cooperate with tenons arranged on the inner surface of the female connector element.

8. A connector as claimed in claim 7, characterized in that each tenon of the locking collar and of the male flange extends over an angular portion smaller than the smaller value among $$\frac{180°}{N} \text{ and } \frac{360°}{N} - \frac{180°}{P} - 5°,$$

N being the number of tenons of the locking collar arranged over a circumference of the collar, P being the number of tenons of the ring arranged over a circumference of the ring.

9. A connector as claimed in claim 1, characterized in that the locking collar is tubular and provided with at least one lateral opening.

10. A connector as claimed in claim 1, characterized in that the collar has a cylindrical surface portion that cooperates with a cylindrical surface portion of the male flange on the periphery of the male flange.

11. A connector as claimed in claim 1, characterized in that each auxiliary tube element is axially abutted against a shoulder provided in the orifices.

12. A connector as claimed in claim 1, characterized in that the locking collar is secured in rotation to the locking ring.

13. A connector as claimed in claim 1, wherein at least one of the elements selected from the group consisting of a main tube element and an auxiliary line element comprises a steel tube hooped by composite strips.

14. A connector as claimed in claim 13, wherein composite strips comprise glass, carbon or aramid fibers, coated with a polymer matrix.

15. A connector as claimed in claim 1, wherein at least one of the elements selected from the group consisting of a main tube element and an auxiliary line element is made of a material selected from the group consisting of reinforcing fibers coated with a polymer matrix, an aluminium alloy, and a titanium alloy.

16. A riser pipe comprising at least two riser pipe sections assembled by a connector as claimed in claim 1, wherein the longitudinal tensional stresses are distributed among the main tube element and the auxiliary tube element.

17. A connector as claimed in claim 1, wherein the locking collar is concentrically mounted on the male flange, and the locking collar is configured for mobile rotation around the outer surface of the male flange.

18. A connector for assembling two riser pipe sections for offshore well drilling operations, comprising:

a first main tube element having as an extension a male connector element provided with a male flange pierced by at least one orifice wherein a first auxiliary tube element is secured, a second main tube element having as an extension a female connector element provided with a female flange pierced by at least one other orifice wherein a second auxiliary tube element is secured, the male connector element being configured to fit into the female connector element so as to connect the two main tube elements and the two auxiliary tube elements, a locking collar and a locking ring, the locking collar being movably mounted around an outer surface of the male flange, the locking collar being configured for mobile rotation around the outer surface of the male flange, the locking collar being configured to assemble the male flange and the female flange by cooperating with the outer surface of the male flange and an outer surface of the female flange, the locking ring being movably mounted around the male connector element, the locking ring being configured for mobile rotation around the male connector element, the locking ring being configured to assemble the male connector and the female connector by cooperating with an inner surface of the female connector.

* * * * *